US005914305A

United States Patent [19]

Madison et al.

[11] Patent Number: 5,914,305

[45] Date of Patent: Jun. 22, 1999

[54] PEROXYNITRITE BASED BLEACHING SYSTEMS

[75] Inventors: Stephen Alan Madison, New City, N.Y.; Jeremy Elliot Bongardt McCallum, Pompton Lakes; Roy Uwe Rojas Wahl, Cliffside Park, both of N.J.

[73] Assignee: Lever Brothers Company, Division of Conopco, Inc., New York, N.Y.

[21] Appl. No.: 08/959,862

[22] Filed: Oct. 29, 1997

[51] Int. Cl.[6] ..... C11D 7/18; C11D 7/54; C11D 3/39; C11D 3/395

[52] U.S. Cl. ..... 510/367; 510/116; 510/220; 510/238; 510/302; 510/461; 252/186.43; 252/186.44

[58] Field of Search ..... 510/109, 220, 510/238, 302, 367, 461; 252/186.43, 186.44

[56] References Cited

U.S. PATENT DOCUMENTS

| | | | |
|---|---|---|---|
| 5,434,085 | 7/1995 | Capomacchia et al. | 436/116 |
| 5,722,392 | 3/1998 | Skimming et al. | 128/203.12 |
| 5,780,489 | 7/1998 | Brooks | 514/369 |

OTHER PUBLICATIONS

R. Radi, J.S. Beckman, K.M. Bush, B.A. Freeman, "Peroxynitrite Oxidation of Sulthydryls", *J. Biol. Chem.*, 266:4244–4250, 1992.

W.A. Pryor, X. Kin, G.L. Squadrito, "One–and two–electron oxidations of methionine by peroxynitrite", *Proc. Natl. Acad. Sci. USA*, 91:11173:11177, 1994.

W.A. Pryor, G.L. Squadrito, S. Padmaja, "Rapid Oxidation of DL–Selenomethionine by Peroxynitrite", *Free Radic. Biol. Med.*, 21:317–322, 1996.

R. Radi, J.S. Beckman, K.M. Bush, B.A. Freeman, "Peroxynitrite–induced Membrane Lipid Peroxidation: The Cytotoxic Potential of Superoxide and Nitric Oxide", *Arch, Biochem. Biophys.*, 288:481–487, 1991.

P.A. King, V.E. Anderson, J.O. Edwards, G. Gustafson, R.C. Plumb, J.W. Suggs, "A Stable Solid That Generates Hydroxyl Radical upon Dissolution in Aqueous Solutions: Reaction with Proteins and Nucleic Acid", *J. Am. chem. Soc.*, 114:5430–5432, 1992.

Rao M. Uppu, Giuseppe L. Squadrito, Rafael Cueto, William A. Pryor, "Selecting the Most Appropriate Synthesis of Peroxynitrite", *Methods in Enzymology*, vol. 269, pp. 285–295, (Date Unknown).

Richard B.R. Muijsers, Gert Folkerts, Paul A.J. Henricks, Gudarz Sadeghi–Hashjin and Frans P. Nijkamp, "Peroxynitrite: A Two–Faced Metabolite of Nitric Oxide", *Life Sciences*, vol. 60, No. 21, pp. 1833–1845, 1997.

M. Feelisch, J. Ostrowski and E. Noack, "On the Mechanism of NO Release from Sydnonimines", *Journal of Cardiovascular Pharmacology* 14; Suppln. 11):S13–S22, 1989 Raven press, Ltd., New York.

K. N. Houk, Kevin R. Condroski and William A. Pryor, "Radical and Concerted Mechanisms in Oxidations of Amines, Sulfides, and Alkenses by Peroxynitrite, Peroxynitrous Acid, and the Peroxynitrite–$CO_2$ Adduct: Density Functional theory Transition Structures and Energetics", *J. Am. Chem. Soc.*, 1996, 118, pp. 13002–13006.

*Primary Examiner*—Alan Diamond
*Assistant Examiner*—John M. Petruncio
*Attorney, Agent, or Firm*—Milton L. Honig

[57] ABSTRACT

Bleaching compositions and a method are reported using peroxynitrite for bleaching as an active substance. Stains and soil can be removed from fabrics, household hard surfaces, dentures and other substrates.

10 Claims, No Drawings

PEROXYNITRITE BASED BLEACHING SYSTEMS

BACKGROUND OF THE INVENTION

1. Field of the Invention

The invention relates to bleaching compositions and a method employing these compositions for cleaning substrates, especially fabrics, hard surfaces and dentures.

2. The Related Art

Many household and personal care products are formulated with a peroxygen material to effect removal of stain and soil. Typical materials which have been used in commerce are hydrogen peroxide, sodium perborate, sodium percarbonate, benzoyl peroxide, peracetic acid (generated through precursor compounds such as TAED) and persulfate (Oxone). Each of these has at least one important limitation. For instance, hydrogen peroxide, perborate and percarbonate require activating catalysts. Often the catalysts are expensive and in manufacturing environments may act as skin sensitizers. Instability is another problem with peroxygen materials. Peroxides are also aggressive against dyes resulting in color damaged substrates (e.g. fabrics). Considerable research has therefore been conducted to discover alternative bleaching systems.

Peroxynitrite is a free radical nitric oxide variant which has attracted considerable biochemical study. Free radical nitric oxide, •NO, an otherwise relatively toxic classified gas indirectly regulates the relaxation of vascular smooth muscle of blood cells in humans. It also plays an important role as a secondary messenger molecule in the nervous system. See R. F. Furchgott, J. V. Zawadzki, *Nature* (London), 1980, 288, 373; R. M. J. Palmer, A. G. Ferrige, S. Moncada, *Nature,* 1987, 327, 524; and L. J. Ignarro, G. M. Buga, K. S. Wood, R. E. Burns, G. Chaudhuri, *Proc. Natl. Acad. Sci., USA,* 1987, 84, 9265. An article by S. Moncada, R. M. J. Palmer, E. A. Higgs, *Pharmacol. Rev.,* 1991 43, 109 reported generation of peroxynitrite in vivo from L-arginine by the enzyme •NO-synthase. The realization that •NO is generated in biological systems has led to an explosion of new research in physiology, pathology and pharmacology.

More recent investigations have shown that •NO reacts in a diffusion controlled reaction with super oxide, a reduced form of oxygen, to yield peroxynitrite. The latter is stable in alkaline solutions. See R. E. Huie, S. Padmaja, *Free Rad. Res. Commun.,* 1993, 18, 195. Several experimental studies have employed peroxynitrite as an oxidizing agent for various inorganic and organic substrates. See A. M. Al-Ajlouni, E. S. Gould, *Inorg. Chem.,* 1996, 35, 7892 and references cited therein. Lipid oxidation has also been investigated. Soybean phosphatidylcholine liposomes were oxidized to malondialdehyde and conjugated dienes, accompanied by oxygen consumption. However, no significant lipid peroxidation occurred above pH 9.5. See R. Radi, J. S. Beckman, K. M. Bush, B. A. Freeman, *Arch. Biochem. Biophys.,* 1991, 288(2), 481.

Evident from the foregoing background information is that peroxynitrite has attracted considerable academic interest but few practical applications have been considered for this material.

Accordingly, it is an object of the present invention to provide another tool for the bleaching and cleaning of substrates, especially fabrics and household hard surfaces.

Another object of the present invention is to provide a bleaching composition effective at relatively low concentrations thereby achieving a cost effective stain removal system.

Still another object of the present invention is to provide a method for bleaching stained substrates such as clothes, household hard surfaces including dishes, tableware, sinks, toilets and the like, and even dentures.

Other objects of the present invention will become apparent through the following summary, detailed discussion and examples.

SUMMARY OF THE INVENTION

A bleaching composition is provided including:

(i) an effective amount of peroxynitrite sufficient to remove stains from surfaces; and (ii) from about 0.5 to 50% of a surfactant.

Furthermore, a method is provided for bleaching a substrate, especially laundry and household hard surfaces such as dishes, tableware, sinks and toilets and comprising contacting the substrate with a peroxynitrite.

A method is also provided for inhibiting microbial growth on surfaces by applying to those surfaces an effective amount of peroxynitrite.

Yet a further aspect of the present invention is to provide a method for treating the oral cavity to brighten teeth as well as inhibit microbial growth (e.g. plaque, tartar and gingivitis) by application of peroxynitrite within the oral cavity.

DETAILED DESCRIPTION

It has been found that peroxynitrite operates as an effective bleach against stains and soils. Consumer and industrial articles can effectively be bleached to remove stains and soils present on such articles.

Peroxynitrite can be obtained in a number of ways, many of which have been summarized by R. M. Uppu, G. L. Squadrito, R. Cueto and W. A. Pryor, *Methods of Enzymology,* Vol. 269, 26, pages 285–295 (1996). Among the methods are the reaction of ozone with azide ions, autooxidation of hydroxylamine, reaction of hydrogen peroxide with nitrous acid, reaction of hydrogen peroxide with alkyl nitrites, reaction of •NO with hydrogen peroxide, reaction of •NO with solid potassium super oxide, and reaction of •NO with $O_2$-formed simultaneously from a single source. The latter method is a particularly preferred one. It involves the auto oxidation of sydnones and sydnonimines with respective structures I and II as follows:

(I)

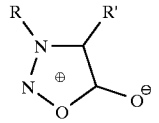

(II)

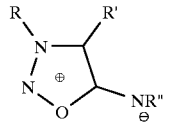

Wherein R, R' and R" independently may be hydrogen or a hydrocarbyl group having from 1 to 50 carbon atoms selected from the group consisting of substituted and unsubstituted alkyl, cycloalkyl, alkene, phenyl, aryl and heterocyclic radicals. Typical substitutents on R, R' or R" may be functional groups with up to 20 carbon atoms selected from cyano, nitro, halo, carboxylate, thio, alkoxy, carboalkyoxy, hydroxy, sulfono, sulfato, phospho, amino, alkyl, cycloalkyl, acyl, amino, aminoalkyl, thioalkyl, sulfoxyalkyl, carboxyester, polyalkoxy and quaternary di- or tri-alkylammonium radicals and mixtures thereof.

Typical heterocyclic radicals include cycloaliphatic and cycloaromatic rings incorporating an oxygen, sulfur and/or nitrogen atom within the ring system. Representative nitrogen heterocycles include pyridine, morpholine, pyrrole, imidazole, triazole, tetrazole, pyrrolidine, piperidine and piperazine. Suitable oxygen heterocycles include furan, tetrahydrofuran and dioxane. Sulfur heterocycles may include thiophene and tetrahydrothiophene. Structures I and II also can be substituted with rings wherein R may be joined to R' or R". Likewise, R' may be joined to R".

3-(2,5,-dimethylpyrrolidino)sydnonimine hydrochloride;

3-(2-hydroxycyclohexylamino)sydnonimine ethylcarbamide;

3-(N,N-dibenzylamino)sydnonimine hydrochloride;

3-cyclohexylaminosydnonimine hydrochloride;

3-(2-hydroxyethylamino)sydnonimine hydrochloride.

For purposes of experimentation, peroxynitrite was generated through the auto oxidation of SIN-1 in a procedure schematically presented below.

SIN-1(3-Morpholinosydnonimine) Production of Peroxynitrite

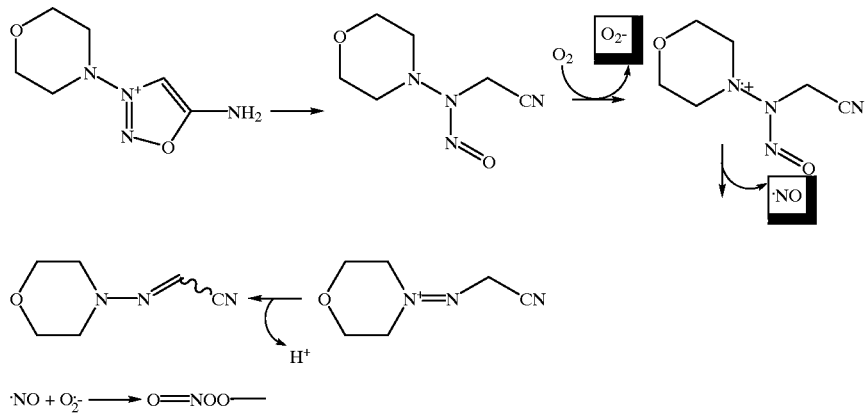

Illustrative but not limiting examples of •NO generating compounds are as follows:

3-morpholinosydnonimine-N-ethylcarbamide;

2-(N-nitrosomorpholinamino)isobutyronitrile;

3-(thiomorpholino-S,S-dioxide)sydnonimine hydrochloride;

3-(4-methylsulfonylpiperazino)sydnonimine hydrochloride;

3-(4-dimethylaminosulfonylpiperazino)sydnonimine hydrochloride;

3-(thiomorpholino-S-oxide)sydnonimine hydrochloride;

3-[4-(4-tolylsulfonyl)-piperazino]sydnonimine hydrochloride;

3-(4-ethoxycarboxypiperazino)sydnonimine hydrochloride;

3-(N-methyl-N-tetrahydrothien-3-yl)sydnonimine hydrochloride;

3-dimethylaminosydnonimine hydrochloride;

3-piperidinosydnonimine hydrochloride;

3-(2,2,6,6-tetramethylpiperidino) sydnonimine hydrochloride;

3-(2,6-dimethylpiperidino)sydnonimine hydrochloride;

3-(2,2,6,6-tetramethylmorpholino)sydnonimine hydrochloride;

3-(2,6-dimethylthiomorpholino-S,S-dioxide) sydnonimine hydrochloride;

3-(N-t-butyl)-2-hydroxyethylamino)sydnonimine hydrochloride;

3-(2,2-dimethyl-4-isopropylpiperazino)sydnonimine hydrochloride;

Amounts of the peroxynitrite in compositions according to the present invention will range from about 0.01 to about 30%, preferably from about 0.1 to about 20%, optimally from 0.5 to 10% by weight.

Peroxynitrite bleach systems of the present invention may be employed for a wide variety of purposes, but are especially useful in the cleaning of laundry. When intended for such purpose, the peroxynitrite will usually also be combined with a surfactant, and optionally with detergent builders and other ingredients of laundry detergent formulations.

The surfactant may be naturally derived, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of surfactant may range up to 50% by weight, preferably being from 0.5 to 40% by weight of the composition, most preferably 4 to 25%.

Synthetic anionic surfactants are usually water-soluble alkali metal salts of organic sulfates and sulfonates having alkyl radicals containing from about 8 to about 22 carbon atoms.

Examples of suitable synthetic anionic surfactants are sodium and ammonium alkyl sulfates, especially those obtained by sulfating higher ($C_8$–$C_{18}$) alcohols produced for example from tallow or coconut oil; sodium and ammonium alkyl ($C_9$–$C_{20}$) benzene sulfonates, sodium alkyl glyceryl ether sulfates, especially those ethers of the higher alcohols derived from tallow or coconut oil and synthetic alcohols derived from petroleum; sodium coconut oil fatty acid monoglyceride sulfates and sulfonates; sodium and ammonium salts of sulfuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulfonates such as those derived by reacting alpha-olefins ($C_8$–$C_{20}$) with sodium bisulfite and those derived by reacting paraffins with $SO_2$ and $Cl_2$ and then hydrolyzing with a base to produce a random sulfonate; sodium and ammonium $C_7$–$C_{12}$ dialkyl sulfosuccinates; and olefin sulfonates, which term is used to describe the material made by reacting olefins, particularly $C_{10}$–$C_{20}$ alpha-olefins, with $SO_3$ and then neutralizing and hydrolyzing the reaction product. The preferred anionic surfactants are sodium ($C_{11-C15}$) alkylbenzene sulfonates, sodium ($C_{12}$–$C_{18}$) alkyl glycerol sulfonates, sodium ($C_{16}$–$C_{18}$) alkyl sulfates and sodium ($C_{16}$–$C_{18}$) alkyl ether sulfates.

Examples of suitable nonionic surfactants which may be used, preferably together with the anionic surfactants, include in particular the reaction products of alkylene oxides, usually ethylene oxide, with alkyl ($C_6$–$C_{22}$) phenols, generally 5–25 EO, i.e. 5–25 units of ethylene oxide per molecule; the condensation products of aliphatic ($C_8$–$C_{18}$) primary or secondary linear or branched alcohols with ethylene oxide, generally 2–30 EO, and products made by condensation of ethylene oxide with the reaction products of propylene oxide and ethylene diamine. Other so-called nonionic surface-actives include alkyl polyglucosides, long chain tertiary amine oxides, and saccharide fatty amides such as methyl gluconamides.

Amphoteric or zwitterionic surfactants such as alkylamidopropyl betaines and lauroamphoacetates can also be used in the compositions of the invention. Amounts of these surfactants may range from 0.1 to 30% by weight.

Soaps may be incorporated into the compositions of the invention, preferably at a level of less than 30% by weight. They are particularly useful at low levels in binary (soap/anionic) or ternary mixtures together with nonionic or mixed synthetic anionic and nonionic compounds. Soaps which are used are preferably the sodium, or less desirably potassium, salts of saturated or unsaturated $C_{10}$–$C_{24}$ fatty acids or mixtures thereof. The amount of such soaps can be varied between 0.5 and 25% by weight, with lower amounts of 0.5 to 5% being generally sufficient for lather control. Amounts of soap between 2 and 20%, especially between 5 and 15, are used to give a beneficial effect on detergency. This is particularly valuable in compositions used in hard water where the soap acts as a supplementary builder.

The relative molar amounts of peroxynitrite and surfactant may range from 1:1 to 1:5,000, preferably from 1:10 to 1:100.

The bleaching compositions of the invention will normally also contain a detergency builder. Builder materials may be selected from (1) calcium sequestrant materials, (2) precipitating materials, (3) calcium ion-exchange materials and (4) mixtures thereof.

In particular, the compositions of the invention may contain any one of the organic or inorganic builder materials, such as sodium or potassium tripolyphosphate, sodium or potassium pyrophosphate, sodium or potassium orthophosphate, sodium carbonate, the sodium salt of nitrilotriacetic acid, sodium citrate, carboxymethylmalonate, carboxymethyloxysuccinate, tartrate mono- and di-succinate, oxydisuccinate, crystalline or amorphous aluminosilates and mixtures thereof.

Polycarboxylic homo- and co-polymers may also be included as builders and to function as powder structurants or processing aids. Particularly preferred are polyacrylic acid (available under the trademark Acrysol from the Rohm and Haas Company) and acrylic-maleic acid copolymers (available under the trademark Sokalan from the BASF Corporation) and alkali metal or other salts thereof.

These builder materials may be present from 1 to 80% by weight, preferably from 10 to 60% by weight.

Upon dispersal in a wash water, the initial amount of peroxynitrite may range anywhere from 0.01 to 250 ppm per liter of water, preferably from 1 to 100 ppm. Surfactant may be present in the wash water from 0.05 to 1.0 grams per liter, preferably from 0.15 to 0.20 grams per liter. When present, the builder amount will range from 0.1 to 3.0 grams per liter.

Apart from the components already mentioned, the bleaching compositions of the invention can contain any of the conventional additives in the amounts in which such materials are normally employed in bleaching or detergent compositions. Examples of these additives include dye transfer inhibition agents (e.g. polymers based on N-vinylpyrrolidone and N-vinylimidazole), lather boosters such as alkanolamides, particularly the monoethanolamides derived from palmkernel fatty acids and coconut fatty acids, lather-depressants such as alkyl phosphates and silicones, anti-redeposition agents such as sodium carboxymethylcellulose and alkyl or substituted alkylcellulose ethers, stabilizers such as ethylene diamine tetraacetic acid and phosphonic acid derivatives (Dequest®), fabric softening agents, inorganic salts such as sodium sulfate, and, usually present in very small amounts, fluorescent agents, perfumes, enzymes such as proteases, cellulases, lipases and amylases, germicides and colorants.

Among consumer products which may incorporate this invention are laundry detergents, laundry-bleaches, hard surface cleaners (e.g. scouring cleansers), toilet bowl cleaners, automatic dishwashing compositions and even denture cleaners. Stained consumer products benefiting from treatment with compositions of this invention may include clothes and other fabrics; household fixtures and appliances such as sinks, toilet bowls and oven ranges; tableware such as drinking glasses, dishes, cookware and utensils; and even dentures. Hair colorants may also be formulated with the bleaching compositions of this invention. The bleaching system of this invention may also be applied to industrial uses such as for the bleaching of wood pulp.

Scouring cleansers may be formulated with peroxynitrite at levels ranging from 0.001 to 30% by weight. These hard surface cleaners will generally contain an abrasive material usually in the form of water-insoluble particles with particle size diameters ranging from 1 to 250 micron, the particles usually having a specific gravity of from 0.5 to 5, and a Mohs' hardness of 2 to 7. Preferably, the diameter of the particles is from 10 to 150, most preferably from 20 to 100 microns. The specific gravity is preferably from 1 to 3.

Examples of suitable abrasive materials include, but are not limited to, quartz, pumice, pumicite, titanium dioxide, silica sand, calcium carbonate, zirconium silicate, diatomaceous earth, whiting, felspar, alumina, corundum, volcanic ash, bentonite, magnesium oxide, magnesium carbonate, chalk, dolomite, shell, talc, calcite, sodium bicarbonate and mixtures thereof. Amounts of the abrasive material may range from 1 to 99%, preferably from 60 to 80% by weight.

Besides the abrasive and bleach, the hard surface cleaner may also contain a surfactant and a carrier. Typically the carrier is water. Surfactants have already been described with respect to laundry formulations, and the surfactants would also be suitable for cleaning hard surfaces.

The bleaching system of the present invention may be delivered in a variety of product forms including powders, on sheets or other substrates, in pouches, in tablets, in aqueous liquids, or in nonaqueous liquids such as liquid nonionic detergents.

The following examples will more fully illustrate the embodiments of this invention. All parts, percentages and proportions referred to herein and in the appended claims are by weight unless otherwise indicated.

EXAMPLE 1

General

Peroxynitrite was prepared by the reaction of sodium azide with ozone generated in a Fischer Model 500 M Ozonator. More specifically, oxygen was purged for 150 minutes through the Ozonator (flow rate: 100 mL $min^{-1}$). Resultant ozone was directed through a glass frit into a chilled ice bath solution of 100 mL of 0.1 N sodium azide(adjusted to pH 12 with 1 N NaOH). A 10% solution of potassium iodide in a 0.07 M phosphate buffer at pH 7 was employed to destroy any excess ozone. Maximum yields of peroxynitrite obtained were 36 mM as determined by ultraviolet analysis.

Bleach Studies

Stain bleaching was measured reflectometrically using a Garner BYK Colorgard System Reflectometer 2000/05. Bleaching was indicated by an increase in reflectance, reported as ΔΔR. In general, ΔΔR of one unit is perceivable in a paired comparison while ΔΔR of two units is perceivable monadically. In reporting the reflectance change, the change in reflectance caused by general detergency has been accounted for. Thus ΔΔR can actually be expressed as:

$$\Delta\Delta R=[\Delta R \text{ peroxynitrite+detergent}]-\Delta\text{detergent}$$

where ΔR is the reflectance difference of the stained fabric after and before washing.

TABLE I

BC-1 Cloth Results

| Terg Time (Hours) | ΔΔR |
|---|---|
| 0.5 | 8.25 |
| 2 | 16.23 |
| 3.5 | 15.78 |
| 5 | 15.19 |

Stain bleaching experiments were conducted in a Terg-O-Tometer open to the air utilizing 200 mL buffer solution (0.1 M phosphate buffer). Experiments were run at 25° C. and pH 12 except as otherwise noted. Peroxynitrite was dosed at 6 mM initial concentration. The substrate was a tea (BC-1) stained cotton cloth. The experiments were conducted in the dark to eliminate any possible light induced activation and insure reproducibility of the results. See Table I.

A further study examined the effect of pH. For these experiments, the Terg-O-Tometer conditions were 25° C., 0.3 M phosphate buffer, 30 minutes terging time and 6 mM initial peroxynitrite concentration. Table II reports these results.

TABLE II

BC-1 Cloth Bleaching at Various pH Levels

| pH | ΔΔR |
|---|---|
| 7 | 0.86 |
| 8 | 8.79 |
| 9 | 13.71 |
| 10 | 18.59 |
| 11 | 12.76 |
| 12 | 5.2 |

An experiment was conducted to compare the bleaching effect between peroxynitrite and a typical organic peracid, i.e. peracetic acid. The conditions employed were 25° C., pH 10 with 0.1 M phosphate buffer, 30 minutes terging time and 6 mM initial peroxynitrite concentration. The ΔΔR on BC-1 stained cloth for peroxynitrite and peracetic acid were respectively 18.35 and 14.35.

From the foregoing experiments it is evident that peroxynitrite is operative across a broad pH spectrum but is most effective against tea stains in the pH 8–11 range and is at least as effective as peracetic acid.

Other experiments were conducted to evaluate effectiveness against a variety of common stains other than tea. These are reported in Table III.

TABLE III

Stain Removal Profile

| Monitor Stain Cloths | ΔΔR (Without Prewash) | ΔΔR (Prewashed)* |
|---|---|---|
| Tea (BC1) | | 19.77 |
| wine (EMPA 114) | 16.48 | 26.78 |
| curry (BC4) | 9.65 | 6.21 |
| tomato (CS20) | 8.93 | 6.25 |
| grass (CS8) | 6.95 | 7.11 |
| blueberry (CS15) | 5.11 | 30.98 |
| chlorophyll/veg oil (AS4) | 2.28 | 2.39 |
| black currant (CS12) | 1.83 | 22.00 |
| carbon/olive oil (EMPA 101) | 0.81 | 1.12 |
| strawberry (CS18) | −0.47 | 29.30 |
| blood (CS1) | −6.69 | 9.15 |

*the use of prewashed cloths (with Surf ®) was necessary because for many non-prewash cloths the stain bled into solution where peroxynitrite bleached the dissolved stain and did not attack the stain with the fabric/wash liquor interface. In those cases where this effect cannot occur, e.g. BC1, the ΔΔR values were consistent with or without the prewash.
conditions:
25° C., pH 10, phosphate buffer, 30 min terg time, 6 mM init. peroxynitrite conc.

Evident from Table III is that peroxynitrite has effectiveness against a variety of different types of stains.

Some types of bleaching agents are quite detrimental to cloth, especially cotton. This is one reason why not every bleaching agent is suitable for cleaning fabrics. A degradation study was conducted on bleached, mercerized, combed cotton broadcloth. Table IV reports the results of that study. No significant fabric degradation was noted after a 5 hour wash. Peroxynitrite is therefore viewed as a substance suitable for contact with this sensitive fabric.

TABLE IV

| Burst Strength Test | | |
|---|---|---|
| Cell | Control Cloths (psi) | Peroxynitrite Cloths (psi) |
| 1 | 114 | 122 |
| 2 | 106 | 129 |
| 3 | 130 | 116 |
| 4 | 127 | 130 |
| 5 | 124 | 129 |
| 6 | 117 | 129 |
| 7 | 123 | 132 |
| 8 | 118 | 109 |
| 9 | 120 | 123 |
| 10 | 127 | 115 |
| 11 | 129 | 128 |
| 12 | 117 | 137 |
| total | 1452 | 1499 |
| mean | 121 | 125 |
| std. dev | 7 | 8 |

Conditions: Jars 1 & 2 — control: 6 cloths (each) in 50 mL of .03 M sodium azide solution at pH 12. Jars 3 & 4 — 6 cloths (each) in 150 mL of 6 mM peroxynitrite solution at pH 12. Mini-terg temperature was set at 40° C. and washed for 5 hours.

EXAMPLE 2

A pair of typical laundry powdered detergent formulations employing peroxynitrite are outlined below.

| COMPONENT | WEIGHT % |
|---|---|
| Sodium carbonate | 40.9 |
| Sodium $C_{12}$ alkyl benzene sulfonate | 9.6 |
| Sodium tripolyphosphate | 5.8 |
| Neodol 45-13 | 3.2 |
| Sodium silicate | 2.9 |
| Sodium hydroxide | 1.1 |
| Peroxynitrite (as SIN-1) | 1.0 |
| Deguest ® 2006 | 1.0 |
| Sodium Sulfate (filler) | balance |
| Zeolite | 30.5 |
| Sodium alkyl sulfate | 9.0 |
| Sodium alkyl ether sulfate | 6.5 |
| Methyl gluconamide | 2.0 |
| Sokalan ® | 2.0 |
| Lypase | 1.0 |
| Protease | 1.0 |
| Cellulase | 0.5 |
| Poly N-vinylpyrrolidone | 0.5 |
| Peroxynitrite (as SIN-1) | 0.5 |
| Sodium Sulfate | balance |

EXAMPLE 3

| COMPONENT | WEIGHT (%) |
|---|---|
| Sodium Dodecylsulfate | 1.7 |
| Dimethylamine Oxide | 2.5 |
| Sodium Chloride | 5.8 |
| Sodium Carbonate | 5.0 |
| Magnesium Hydroxide | 0.3 |
| Peroxynitrite (10% solution) | 10.5 |
| Perfume | 0.1 |
| Calcite | 49.7 |
| Water | balance |

EXAMPLE 4

A typical denture cleansing paste composition is outlined below.

| COMPONENT | WEIGHT % |
|---|---|
| Dicalcium phosphate dihydrate | 36.0 |
| Dicalcium phosphate anhydrous | 12.0 |
| Sorbitol (70% active) | 9.0 |
| Glycerin | 9.0 |
| Sodium lauryl sulfate | 2.0 |
| Sodium benzoate | 2.0 |
| Magnesium aluminum silicate | 1.0 |
| Sodium carboxymethyl cellulose | 0.5 |
| Flavor | 0.5 |
| Water | balance |

The foregoing description and examples illustrate selected embodiments of the present invention. In light thereof variations and modifications will be suggested to one skilled in the art, all of which are within the spirit and purview of this invention.

What is claimed is:

1. A bleaching composition comprising:

(i) from about 0.01 to 30% of peroxynitrite sufficient to remove stains from surfaces; and (ii) from about 0.5 to 50% of a surfactant selected from the group consisting of anionic, nonionic, amphoteric, zwitterionic actives and mixtures thereof.

2. The composition according to claim 1 further comprising from 1 to 80% by weight of a detergent builder.

3. The composition according to claim 1 further comprising an effective amount for cleaning of an enzyme selected from the group consisting of proteases, cellulases, lipases, amylases and mixtures thereof.

4. The composition according to claim 1 which is formulated into a form selected from the group consisting of a powder, sheet, pouch, tablet, aqueous liquid and nonaqueous liquid.

5. The composition according to claim 1 wherein the peroxynitrite is generated from a precursor compound.

6. A method for bleaching a stained substrate, the method comprising contacting the stained substrate in an aqueous medium with a peroxynitrite and a surfactant in an effective amount to clean the substrate, and wherein peroxynitrite and surfactant are present in a molar ratio from 1:1 to 1:5,000.

7. The method according to claim 6 wherein the ratio of peroxynitrite to surfactant ranges from 1:10 to 1:100.

8. A method according to claim 6 wherein the substrate is selected from the group consisting of fabrics, household fixtures, dishes and tableware.

9. A method according to claim 6 wherein the substrate is a denture.

10. A method for bleaching a stained substrate, the method comprising contacting the stained substrate in an aqueous medium which contains a peroxynitrite and a surfactant, the medium containing 0.01 to 250 ppm peroxynitrite and 0.05 to 1.0 gram surfactant per liter of medium.

* * * * *